US005818414A

United States Patent [19]

Jaki et al.

[11] Patent Number: 5,818,414

[45] Date of Patent: Oct. 6, 1998

[54] SINGLE DISPLAY DEVICE WITH PASSIVE COMPONENTS, IN PARTICULAR FOR DISPLAYING CHARACTERS WHICH CONSIST OF A PLURALITY OF MATRIX-ARRANGED PICTURE ELEMENTS

[76] Inventors: Laszlo Jaki, Kosztolanyitér 12, 1114 Budapest; Sandor Szenassy, Pitvar m.3, 1141 Budapest; Laszlo Szidor, Kriven U.S., 1142 Budapest, all of Hungary; Jessie D. Swinea, 222 W. Laralo, Royal Oak, Mich. 48073

[21] Appl. No.: 569,226

[22] PCT Filed: Jun. 24, 1994

[86] PCT No.: PCT/HU94/00023

§ 371 Date: Feb. 29, 1996

§ 102(e) Date: Feb. 29, 1996

[87] PCT Pub. No.: WO95/01620

PCT Pub. Date: Jan. 12, 1995

[30] Foreign Application Priority Data

Jun. 30, 1993 [HU] Hungary ..... 93 01901

[51] Int. Cl.[6] ..... G09G 3/34; G09F 9/00; G08B 5/22

[52] U.S. Cl. ..... 345/111; 40/449; 340/815.62

[58] Field of Search ..... 345/108, 110, 345/111, 109; 340/815.62, 815.64, 815.65, 815.67, 815.68, 815.86, 815.88, 815.9; 40/446, 447, 449, 463

[56] References Cited

U.S. PATENT DOCUMENTS

| | | | |
|---|---|---|---|
| 3,936,818 | 2/1976 | Skrobisch | 340/815.62 |
| 4,139,841 | 2/1979 | Roberts | 345/111 |
| 4,318,098 | 3/1982 | McGreery | 345/110 |
| 4,328,492 | 5/1982 | Bobak et al. | 345/110 |
| 4,459,587 | 7/1984 | Leuthessen | 345/108 |
| 4,761,905 | 8/1988 | Black | 345/111 |
| 4,775,863 | 10/1988 | Jáki et al. | 40/449 |
| 4,796,368 | 1/1989 | Skrobisch | 40/449 |
| 4,914,427 | 4/1990 | Trunk | 345/111 |
| 5,005,305 | 4/1991 | Turney et al. | 40/449 |
| 5,022,171 | 6/1991 | Norfolk et al. | 40/447 |
| 5,208,589 | 5/1993 | Reynolds | 40/449 |
| 5,325,108 | 6/1994 | Salam | 345/111 |
| 5,550,558 | 8/1996 | Salam | 345/111 |

*Primary Examiner*—Steven Saras
*Assistant Examiner*—Paul A. Bell
*Attorney, Agent, or Firm*—Brooks & Kushman P.C.

[57] ABSTRACT

A signal display device with passive components is disclosed, in particular for displaying characters which consist of a plurality of matrix-arranged picture elements. The device has an information-carrying base plate, suitable in particular for color information. Display elements made of generally cylindrical bodies can preferably swivel around an axis that coincides with their centroidal axis. Said display elements are provided with at least one signal display surface which can swivel in the direction of the information display surface of the base plate and which is suitable for carrying information, preferably information that differs from the information carried by the base plate. The invention is characterized in that the display elements are provided with three such parts which are mutually offset in the direction of their axes and of which two front faces are arranged perpendicularly to the axis and are secured to each other forming a single piece with the signal display surface. Magnetic bodies having faces with a section perpendicular to the axis and preferably a cross-section perpendicular to the same axis have axial dimensions which are substantially smaller than the distance between the faces and which reach at the most half the distance between the faces. Said magnetic bodies ar arranged in the vicinity of the one or the other face of the display elements, preferably on one or the other face of the display elements.

9 Claims, 2 Drawing Sheets

SINGLE DISPLAY DEVICE WITH PASSIVE COMPONENTS, IN PARTICULAR FOR DISPLAYING CHARACTERS WHICH CONSIST OF A PLURALITY OF MATRIX-ARRANGED PICTURE ELEMENTS

The object of this invention is display equipment using passive elements, especially for showing characters by dot-matrix array, which equipment consists:

of a background plate or screen suitable for conveying information preferably using colors, of indicating elements, of specific shape preferably cylindrical in form, rotatable about an axes, preferably about the axes coincident their median, which indicating elements are provided with at least one information-carrying face, suitable for providing bits of information, preferably differing from that information conveyed by the background plate, and rotatable into the plane of the display surface of the background plate.

We are familiar with certain kinds of display equipment using passive indicating elements—such as described in the Hungarian patent application No. 3460/91, where the indicating elements are one or other specific shape and so formed to be pivoted about an axe coincident with their median, and the angle between their two extreme rotating positions being 90 degrees. The space between these two end-surfaces is completely filled by an indicating body and the middle section or whole width of this component has been permanently magnetized. Since, due to the effects of shading, the magnetic fields arising with this design do not permit miniature forms, this kind of indicating element is employed only in the segments of segmented display equipment.

The aim of this invention is to produce an arrangement whereby the shortcomings cited may be eliminated and, by this means, it will be made possible to use such indicating elements in dot-matrix units for the display of characters, and to reduce the dimensions of characters, respectively.

The basis of this invention is the realization that, if we position the magnetic parts within any two adjacent indicating elements in such a way that the magnetic component of one indicating element is one end of it and the magnetic component of the neighboring indicating element is in its other end, then the influence of the magnetic components upon each other is reduced. The result of this will be that the size of the indicating elements, and therefore that of the letters to be displayed, may be reduced. This means that such indicating elements of specific shape, which rotate through 90 degrees from one extreme position to the other—although with present-day techniques they are not yet suitable for producing dot-matrix characters, but are limited to numerical display consisting of segments, preferably of seven segments—they may, by virtue of the design in this invention, be made suitable also for the display of alphanumeric characters in dot-matrix form.

The essence of this invention is:

the indicating elements are constructed with three parts, along in the direction of their axes, of which parts two end-surfaces, arranged perpendicular to their axes, are united to form one piece with the information-carrying faces, at the same time magnetic bodies, significantly smaller than the distance between the end-surfaces, their dimension in the direction of the axis being not greater than half the distance between the end-surfaces, and the cross-section of magnetic body perpendicular to the axis, preferably identical with the cross-section of the end-surfaces perpendicular to the axis, are arranged in the vicinity of the end-surfaces of the indicating elements, preferably fastened to one or other end-surface of each indicating element.

BRIEF DESCRIPTION OF THE DRAWINGS

Here follows a more detailed description of this invention, with the help of the examples of performance, illustrated in the accompanying drawings, in which.

BEST MODE FOR CARRYING OUT THE INVENTION

Figure 1:
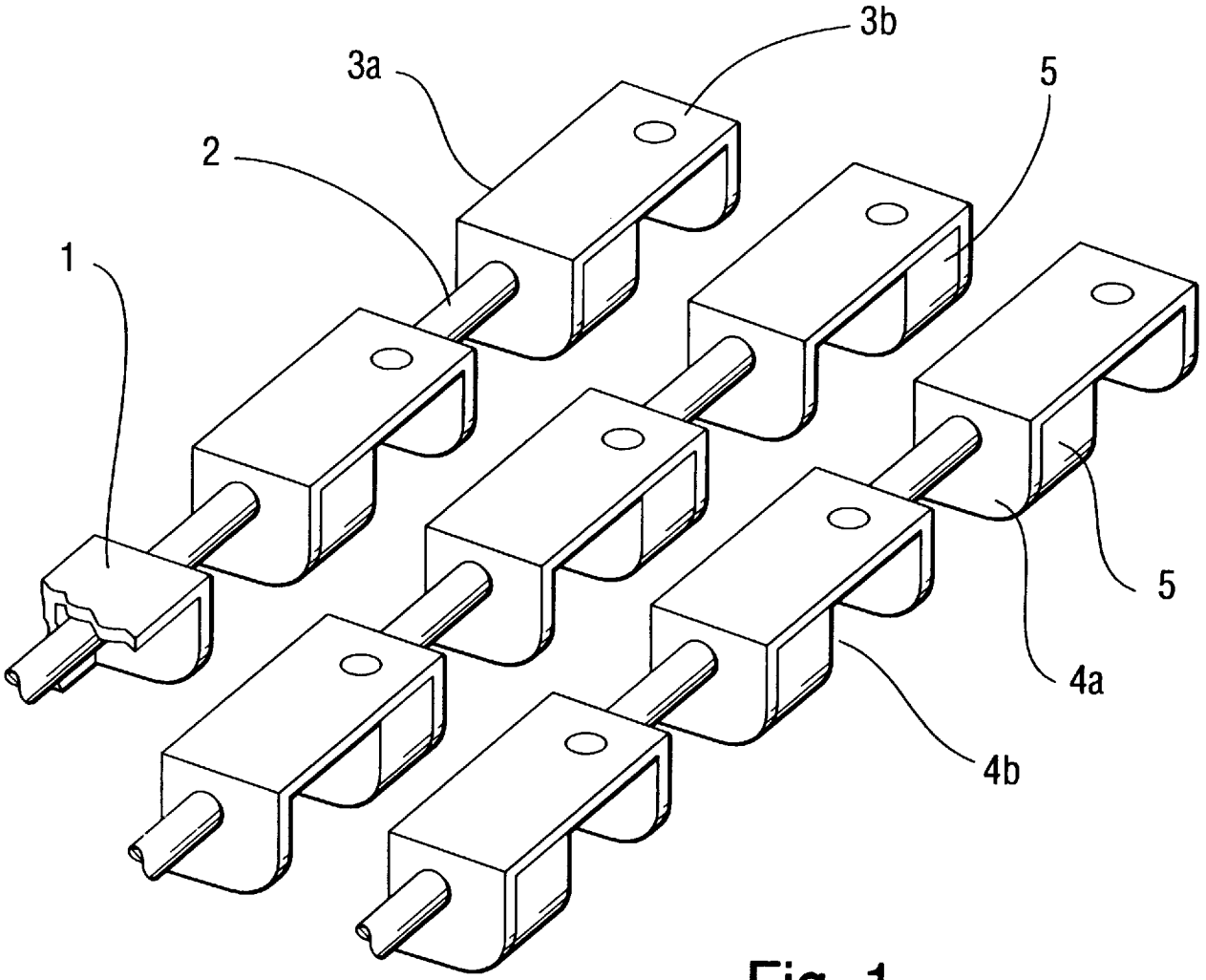
FIG. 1 shows the indicating elements arranged in rows and columns, in the axonometric realization, represented by one of the examples of performance of this invention.

The indicating elements 1 to be seen in FIG. 1 are illustrated arranged in rows and columns. Those indicating elements 1 positioned in the same row are linked preferably by a common axis 2, while they are free to rotate independently from each other on this axis 2. The axis 2 should be arranged expediently on the median of the indicating elements 1 of specific shape.

As shown by this example, the cross-section of the indicating elements 1, perpendicular to the axis 2, is a rectangle with one corner rounded off. Those two faces of the indicating element 1 which meet in the edge diagonally opposite the rounded edge form information-carrying faces 3*a*, 3*b*. The indicating element 1 essentially comprises these two information-carrying surfaces 3*a*, 3*bh*, the end-surfaces 4*a*, 4*b*, which mark off the two ends of the information-carrying surfaces 3*a*, 3*b* and the magnetic body 5 positioned between the two end-surfaces 4*a*, 4*b*. The cross-section, perpendicular to the axis 2, of the two end-surfaces 4*a*, 4*b* and of the magnetic bodies 5 are preferably identical with each other and this cross-section, together with the cross-sections of the information carrying faces 3*a*, 3*b*, form the cross-section perpendicular to the axis 2 of the indicating element 1.

Figure 2:
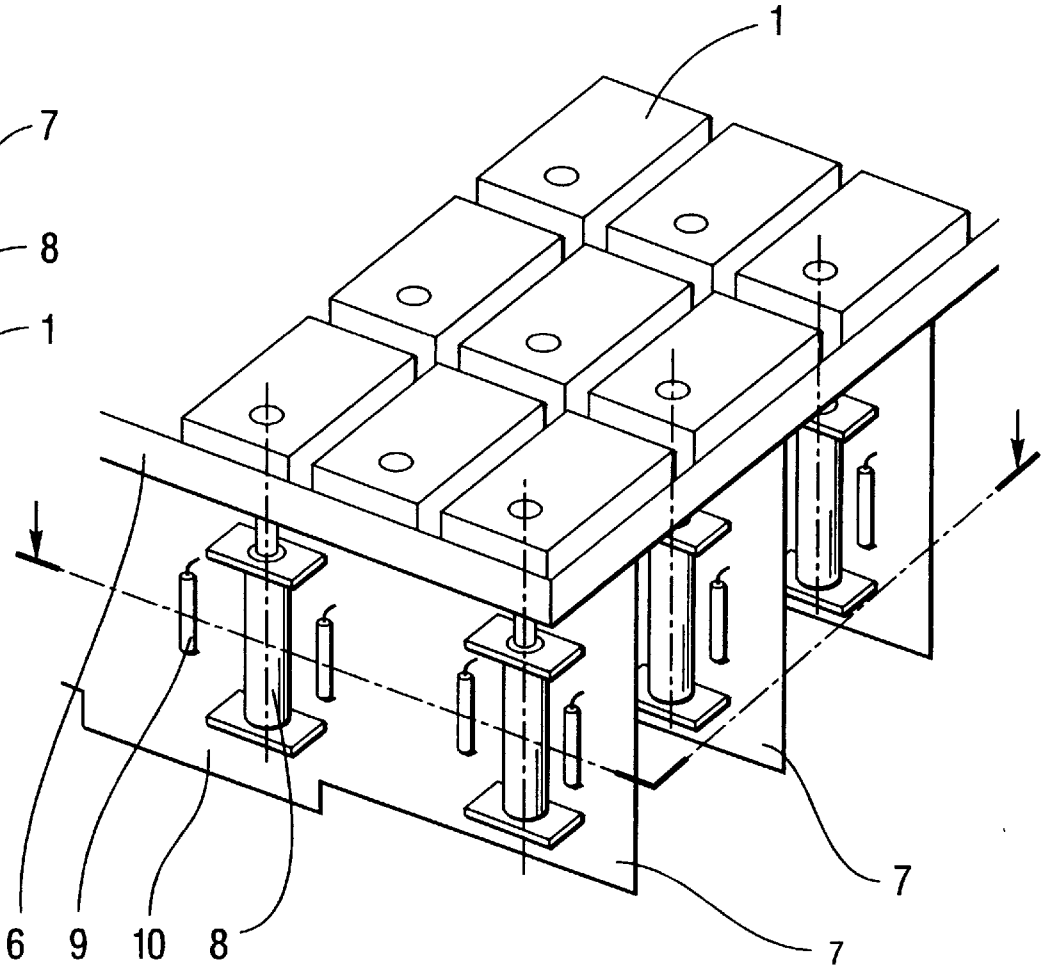
FIG. 2 shows a few indicating elements fitted in the background plate with actuating coils and discs carrying control elements.

The indicating elements 1 are mounted in the background plate 6 in the way illustrated in FIG. 2. Of the two information-carrying faces 3*a*, 3*b*, one or other, e.g. information-carrying surfaces 3*a*, conveys the information, preferably by virtue of the color which it bears for the display. The color of the other information-carrying face 3*b* is identical with that of the background plate 6.

In this invention, in contradistinction to prior art, the magnetic bodies 5 do not fill the space between the end-surfaces 4*a*, 4*b*, and are not placed off-center within the indicating elements 1, respectively. The dimension of the magnetic bodies 5 parallel with the axis 2, is significantly smaller than half the distance between the two end-surfaces 4*a*, 4*b*, indeed not more than half the distance between the two end-surfaces 4*a*, 4*b*. The magnetic bodies 5 are arranged between the two end-surfaces 4*a*, 4*b* in such a way that, in every second row, the magnetic bodies 5 are arranged in the neighboring two rows in the vicinity of one of the two end-surfaces 4*a*, 4*b*, e.g. fastened to the end-surface 4*a*, and in the neighboring two rows in the vicinity of the other end-surface 4*a*, 4*b*, in this case fastened to the end-surface 4*b*. This arrangement is most effective at reducing the influence of one magnetic field upon the other if any one magnetic body 5 is equidistant from the two neighboring magnetic bodies 5 in the two adjacent rows.

Figure 3:
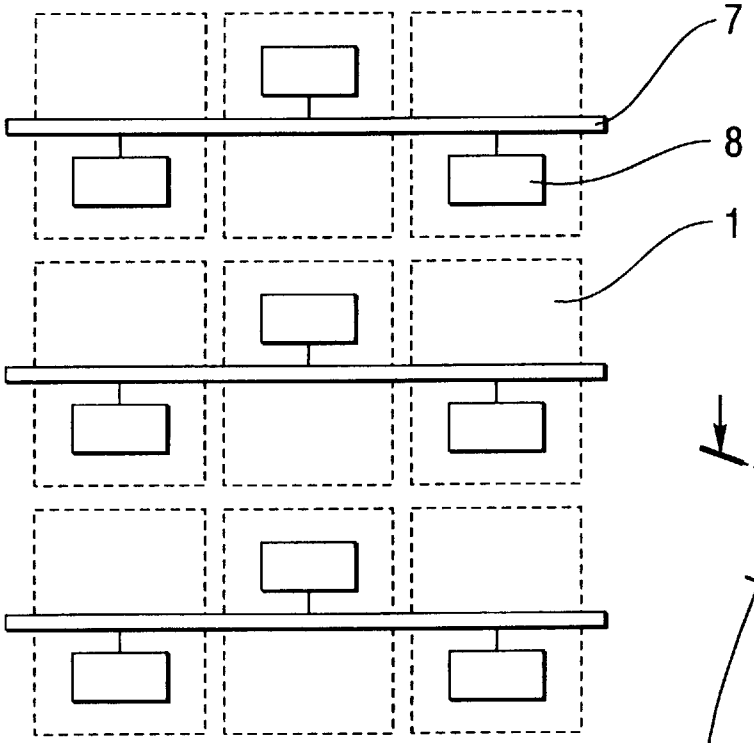
FIG. 3 illustrates the cross-sectional view taken along the plane A—A in FIG. 2.

Positioned behind the background plate 6 are panels 7, fastened with their plane perpendicular to the background plate 6 and perpendicular to the axes 2. These panels 7 are positioned to coincide with the midway plane between the two end-surfaces 4*a*, 4*b* of those indicating elements 1 which lie in the same column. Thus, the magnetic bodies 5 of the indicating elements 1 are fastened alternatively on one side and the other side of the panels 7, respectively. The example is of the case where, every magnetic body 5 is provided with an operating coil 8 arranged behind the background plate 6 with its axis perpendicular to the background plate 6, so that the operating coils 8 may be fastened to both sides of the panels 7, as illustrated in FIG. 3. The panels 7 carry the control elements 9 and, on the edges further from their ends facing the background plate 6, have connections 10 like soldering lugs or formed of their material.

Although the present invention has been described and illustrated in connection with preferred embodiments is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. Display equipment using passive elements, especially for showing characters by dot-matrix array, which equipment comprises:

of a background plate or screen suitable for conveying information preferably using colors;

of indicating elements, of a shaped body cylindrical in form, rotatable about an axis coincident their median;

which indicating elements are provided with at least one information-carrying face, suitable for providing at least one bit of information, differing from that information conveyed by the background plate, and rotatable into the plane of the display surface of the background plate;

characterized in that:

the indicating elements (1) are constructed with three parts, along in the direction of their axes (2), of which parts two end-surfaces (4*a*, 4*b*), arranged perpendicular to their axes (2), are united to form one piece with the information-carrying face (3*a*, 3*b*), at the same time magnetic bodies (5), significantly smaller than the distance between the end-surfaces (4*a*, 4*b*), their dimension in the direction of the axis (2) being not greater than half the distance between the end-surfaces (4*a*, 4*b*), and the cross-section of magnetic body (5) perpendicular to the axis (2), identical with the cross-section of the end-surfaces (4*a*, 4*b*) perpendicular to the axis (2), are arranged in the vicinity of the end-surfaces (41, 4*b*) of the indicating elements (1), fastened to one or other end-surfaces (4*a*, 4*b*) of each indicating element (1).

2. Display equipment as claimed in claim 1, characterized in that the magnetic bodies (5) within the indicating elements (1) situated in the same row, in the direction of their axes (2) are all arranged equidistant from each other and fastened to the one or other end-surfaces (4*a*, 4*b*).

3. Display equipment as claimed in claim 2, characterized in that in the indicating elements (1) of any two adjacent rows, the magnetic bodies (5) in the same row are arranged fastened to the same end-surface (4*a*) or end-surface (4*b*), and the magnetic bodies (5) in the adjacent row to the opposite end-surfaces (4*a*, 4*b*).

4. Display equipment using passive elements, especially for showing characters by dot-matrix array, which equipment comprises:

a background plate having a display surface suitable for conveying information by using colors;

an array of indicating elements in adjacent rows of a shaped body rotatable about an axis coincident their median;

the indicating elements are each provided with information-carrying faces, at least one information-carrying face suitable for providing at least one bit of information differing from that information conveyed by the background plate, and rotatable into the plane of the display surface of the background plate;

each indicating element comprising three parts along the direction of their axes, which parts are two end-surfaces arranged perpendicular to their axes, which are united to form one piece with the information-carrying faces, and a magnetic body, significantly smaller than the distance between the end-surfaces, the dimension of the magnetic body in the direction of the axis being not greater than half the distance between the end-surfaces (4*a*, 4*b*), and the cross-section of magnetic body perpendicular to the axis, identical with the cross-section of the end-surfaces perpendicular to the axis, and arranged in the vicinity of the end-surfaces of the indicating elements and fastened to one or the other of the end-surfaces of each indicating element;

the magnetic bodies within indicating elements situated in the same row in the direction of their axes are all arranged equidistant from each other and fastened to the same end-surfaces; and the magnetic bodies in the adjacent row are fastened to the other of the end-surfaces.

5. Display equipment as claimed in claim 4, characterized in that the operating coils (8) with their axes perpendicular to the background plate (6), are arranged in rows, where the operating coils (8) in one of two adjacent rows are placed with respect to those in the other row in accordance with the arrangement of the magnetic bodies (5).

6. Display equipment as claimed in claim 5, characterized in that the operating coils (8) are fastened to panels (7) containing control elements (9), these panels (7) being fastened to the background plate (6) and arranged perpendicular to the background plate (6) and also to the direction of the axes (2) of the indicating elements (1).

7. Display equipment as claimed in claim 6, characterized in that the panels (7) are double-sided and arranged to include the middle lines of the indicating elements (1) in each column what are perpendicular to the rows, the operating coils (8) being arranged on both sides of the panels (7), in rows which are displaced one from the other.

8. Display equipment as claimed in claim 6, characterized in that on that edge of each panel (7) parallel to the background plate (6) and further from it, there are connections (10).

9. Display equipment as claimed in claim 7, characterized in that on that edge of each panel (7) parallel to the background plate (6) and further from it, there are connections (10).

* * * * *